US006438850B2

(12) United States Patent
Young et al.

(10) Patent No.: US 6,438,850 B2
(45) Date of Patent: Aug. 27, 2002

(54) ROLLER CUTTER WITH RETRACTABLE AND REMOVABLE CUTTER WHEEL

(75) Inventors: Michael W. K. Young, Astoria; Wei Young, Flushing, both of NY (US)

(73) Assignee: Progressive International Corp., Kent, WA (US)

( * ) Notice: Subject to any disclaimer, the term of this patent is extended or adjusted under 35 U.S.C. 154(b) by 0 days.

(21) Appl. No.: 09/827,265

(22) Filed: Apr. 5, 2001

Related U.S. Application Data

(60) Provisional application No. 60/196,875, filed on Apr. 12, 2000.

(51) Int. Cl.[7] ..... B26B 1/08
(52) U.S. Cl. ..... 30/162; 30/319; 30/320
(58) Field of Search ..... 30/162, 151, 307, 30/319, 320, 321, 335, 292, 306; D7/694

(56) References Cited

U.S. PATENT DOCUMENTS 5,101,564 A * 4/1992 Melter ..... 30/319
5,299,355 A * 4/1994 Boda et al. ..... 30/162
5,355,588 A * 10/1994 Brandenburg, Jr. et al. ... 30/319
5,493,781 A * 2/1996 Saito ..... 30/162
D375,435 S * 11/1996 Knapp ..... D7/694
5,711,077 A * 1/1998 Schultz et al. ..... 30/319

FOREIGN PATENT DOCUMENTS

GB 2040207 * 8/1980 ..... 30/162

* cited by examiner

*Primary Examiner*—Hwei-Siu Payer
(74) *Attorney, Agent, or Firm*—John R. Benefiel

(57) ABSTRACT

A roller cutter has a partially circular housing having a slit extending in from receiving a cutter wheel, which can be selectively shifted between an extended cutting position and a retracted position enclosed within the housing to protect the cutter wheel cutting edge. A push button operates a latch release to allow shifting between these positions. A slide bar mounting the cutting wheel for shifting movement is itself held in a slot in the housing, but may be released for removal and cleaning. A tangential grip at the top of housing allows convenient stroking for cutting pizza, mincing herbs, etc.

9 Claims, 4 Drawing Sheets

ROLLER CUTTER WITH RETRACTABLE AND REMOVABLE CUTTER WHEEL

CROSS REFERENCE TO RELATED APPLICATIONS

This application claims the benefit of U.S. provisional serial No. 60/196,875, filed on Apr. 12, 2000.

BACKGROUND OF THE INVENTION

This invention concerns cutters and more particularly cutters having cutter wheels as are used in cutting pizzas. The typical pizza cutter uses a circular blade or cutter wheel rotatably mounted at one end of an elongated handle, which is held while stroking the cutter. These cutters are somewhat bulky and the exposed blade becomes dulled when stored in a drawer with other utensils because of incidental bumping of the cutter edge with the other utensils.

The mounting of the roller cutter blade at one end of an elongated handle precludes convenient use of these tools for other cutting applications as the cutting motion by endwise movement is too clumsy for rapid stroking as when mincing herbs, etc.

It is also desirable to be able to disassemble the cutter for cleaning, but most such cutters do not allow disassembly or are only disassembled with substantial effort.

It is the object of the present invention to provide a roller cutter which is compact and versatile in use, and which protects the cutter edge against dulling when not in use.

SUMMARY OF THE INVENTION

The above recited object and others which will be understood upon a reading of the following specification and claims are achieved by a rolling cutter which includes a housing mounting a cutting wheel to be completely retractable within the housing when not in use to protect the cutter edge, and extended out of the housing to be useable for cutting. The cutter wheel is mounted on a slide bar having a slot allowing the cutting wheel to be moved between an extended and a retracted position. The slide and cutting wheel together are conveniently able to be completely removed from a slot in the housing receiving the slide bar for cleaning upon removal of a locking rod held in a locking position in a first rotated position and able to be withdrawn in a second rotated position, an attached finger knob enabling twisting of the locking rod.

The housing has a grip extending along the top which allows a sideways stroking motion while easily exerting a downward pressure. This allows efficient use of the cutter by a rapid sideways stroking while having good visibility of the cutting edge, useful in mincing herbs, etc., as well as cutting pizza.

DETAILED DESCRIPTION

Figure 1:
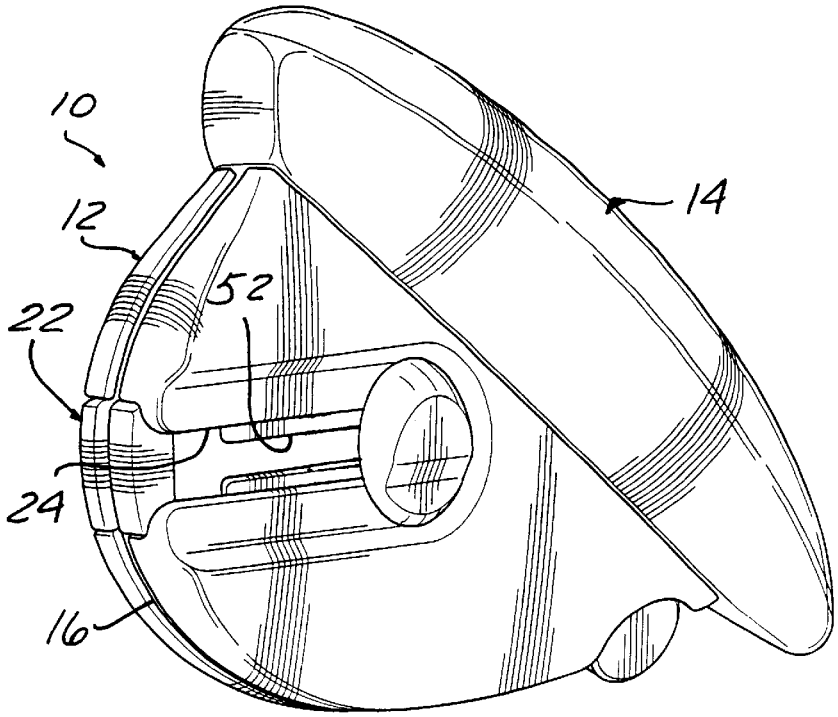
FIG. 1 is a perspective view of the roller cutter according to the present invention, shown with the cutter wheel retracted.
Figure 2:
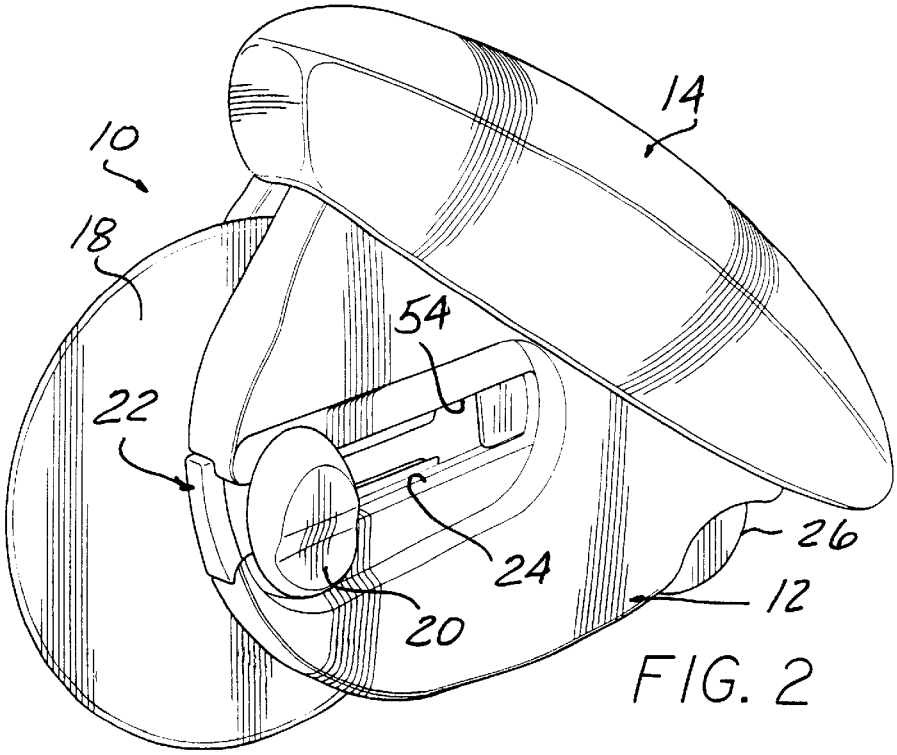
FIG. 2 is a perspective view of the roller cutter shown in FIG. 1, with a cutter wheel in the extended cutting position.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

The roller cutter 10 according to the present invention includes a partially circular housing 12 having a hand grip 14 extending generally tangentially along the top thereof. The housing 12 shown in assembled from two molded halves, and has a slit 16 formed into the bottom and front of the housing 12 in which a steel cutter wheel 18 is received, and from which a cutter wheel 18 can be partially extended from a retracted completely enclosed position within the housing 12. A release button 20 is depressed to allow shifting movement between the retracted and extended positions. The cutter wheel 18 is latched in each of those positions when the button 20 is released.

The cutter wheel 18 can be coated with a nonstick coating such as SILVERSTONE™ available from Dupont.

The cutter wheel 18 is mounted on a slide bar 22 for the shifting movement described, the slide bar 22 itself normally held within a slot 24 formed in the housing 12.

Figure 3:
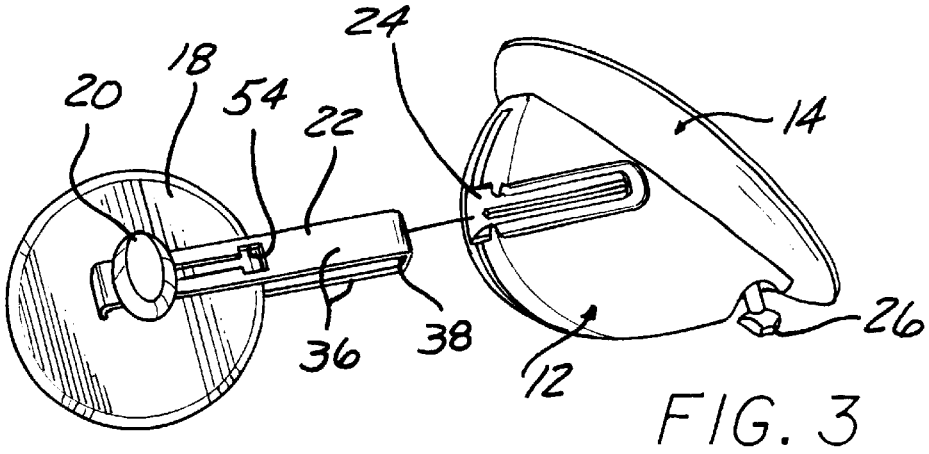
FIG. 3 is a reduced size perspective view of the roller cutter shown in FIGS. 1 and 2 with the cutter wheel and a cutter holder slide bar removed from a cutter housing.

However, assembly of the slide bar 22 and the cutter wheel 18 can be released to be able to be pulled out of the slot 24 by twisting of a finger knob 26 at the bottom rear of the housing 12 and pulling an attached locking rod 28 down to release the slide bar 22 and allow it to be pulled out from the slot 24 (FIG. 3).

Figure 11:
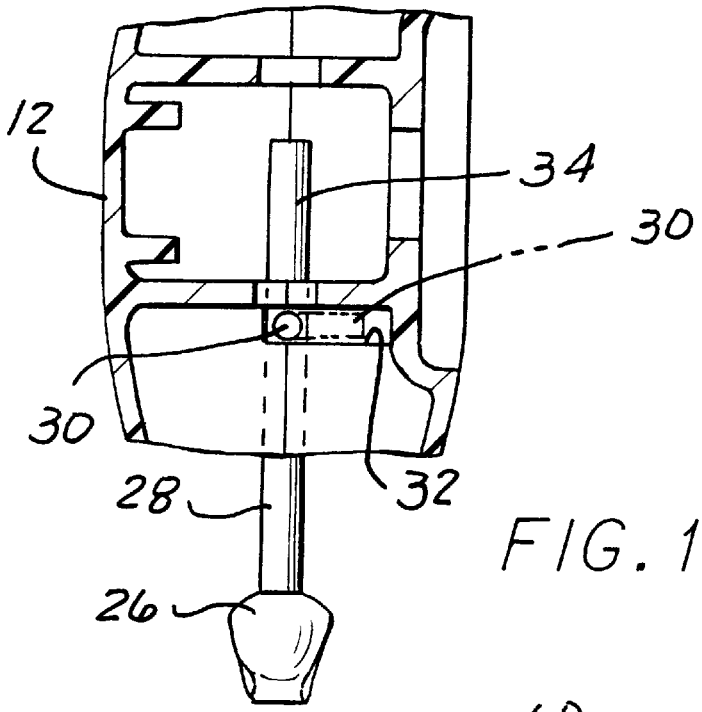
FIG. 11 is an enlarged view of a section taken through the housing showing the locking rod in the locking and released positions.

A side projection 30 when rotated over a ledge 32 formed in the molded plastic housing 12, holds the locking rod 28 in the up position (best seen in FIG. 11) with the upper end 34 of the rod 28 extending between two legs 36 of the slide bar 22 so that the interference with an end wall 38 prevents movement of the slide bar 22 out of the slot 24.

The cutter wheel 18 is freely rotatable on an axle pin 40 threaded to the release button 20 at one end and having a head 42 at the other.

Figure 8:
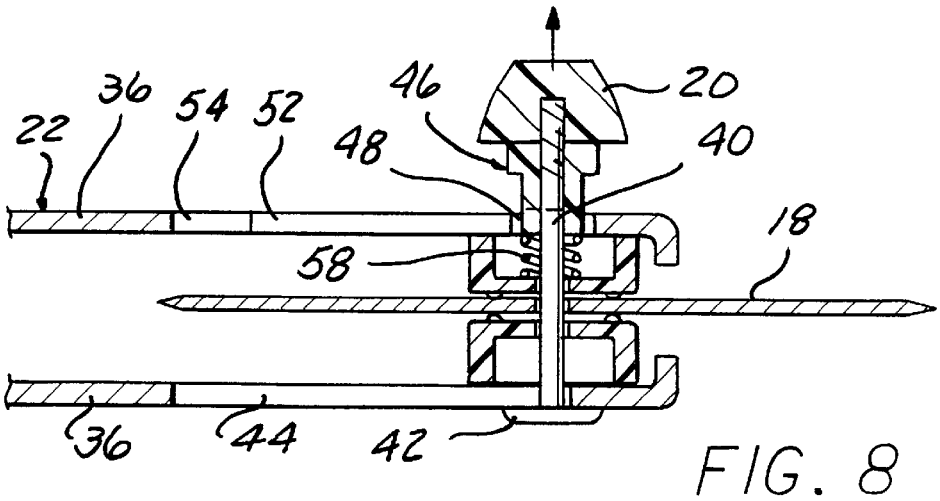
FIG. 8 is a view of the section shown in FIG. 7 with the latching mechanism in the latched position.
Figure 9:
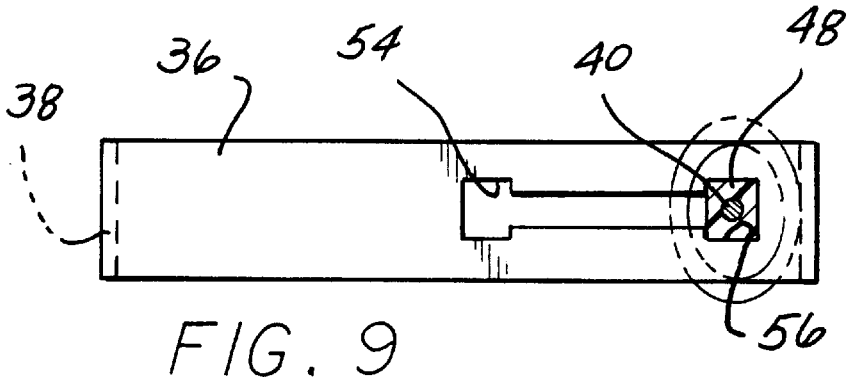
FIG. 9 is a view of a lengthwise section taken through the cutter wheel center with the cutter wheel in the latched position on the slide bar.
Figure 10:
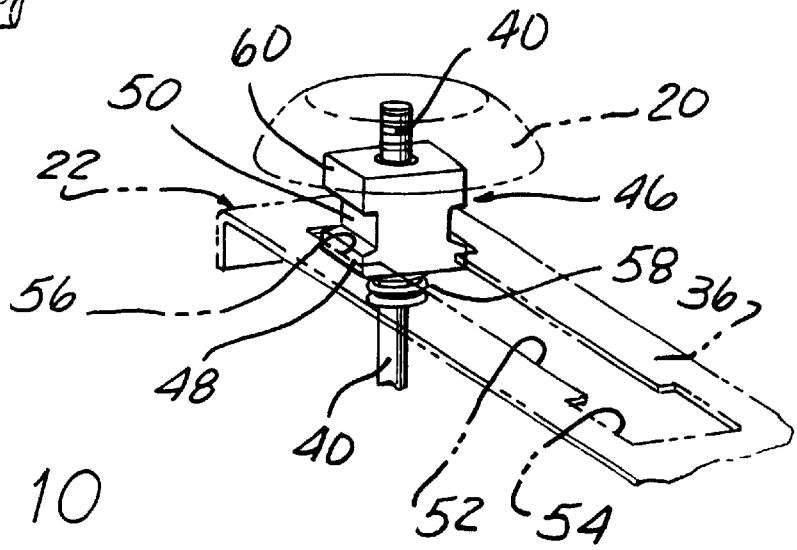
FIG. 10 is a perspective enlarged view rotated by 90°, of the cutter wheel axle and the holder slide and release button in phantom lines and shown in the latched position.

The pin 40 extends through a straight slot 44 extending along one of the legs 36 of the slide bar 22. A stepped portion 46 of the button 20 (FIG. 10) includes a larger rectangular section 48 and a smaller rectangular portion 50. The smaller portion 50 is sized to slide in a straight slot section 52 in the other leg 36 of the slide bar 22, while the larger portion 48 fits into enlarged square cut outs 54, 56 at either end of the straight slot 52 (FIG. 9). The square cut outs 54, 56 are located at the rotation axis center for the retracted and extended position respectively. A spring 58 urges the pin 40 upward as viewed in FIG. 10, tending to seat the larger portion 48 in either of the square cut outs 54, 56 to latch the cutter wheel 18 in either the retracted or extended positions (FIG. 8).

Figure 7:
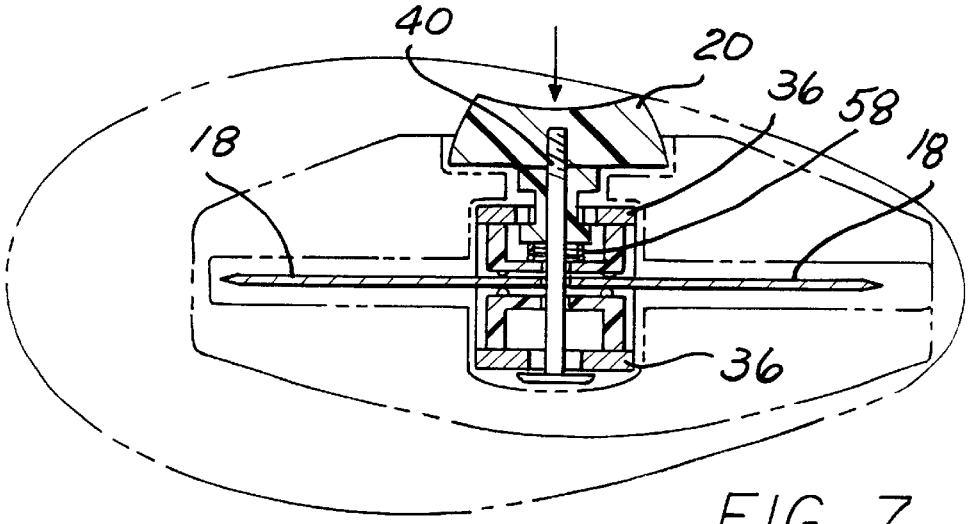
FIG. 7 is a view of a transverse section taken through the cutting wheel holder slide and wheel axle showing the details of the latching mechanism in the released position.

To release the cutter wheel 18, the button 20 is depressed to bring the smaller portion 50 into alignment with the slot 52 (FIG. 7) which then allows sliding movement of the button 20, axle pin 40, and cutter wheel 18 between the extended and retracted positions. The largest rectangular portion 60 on the button 20 is slidable in the slot 24 of the housing 12 to guide the movement of the button 20. Upon reaching the retracted position, the largest portion 60 abuts the end of slot 24, and when the button 20 is released, portion 48 is spring urged into the cut out 54, latching the cutter wheel 18 in position and preventing any sliding movement.

Upon reaching the extended position, the axle pin 40 abuts the end of the slot 44 to locate the same in that position, and upon release of the button 20 the spring 58 pushes the larger portion 48 into the cut out 56, latching the cutter wheel 18 in its extended position.

Figure 4:
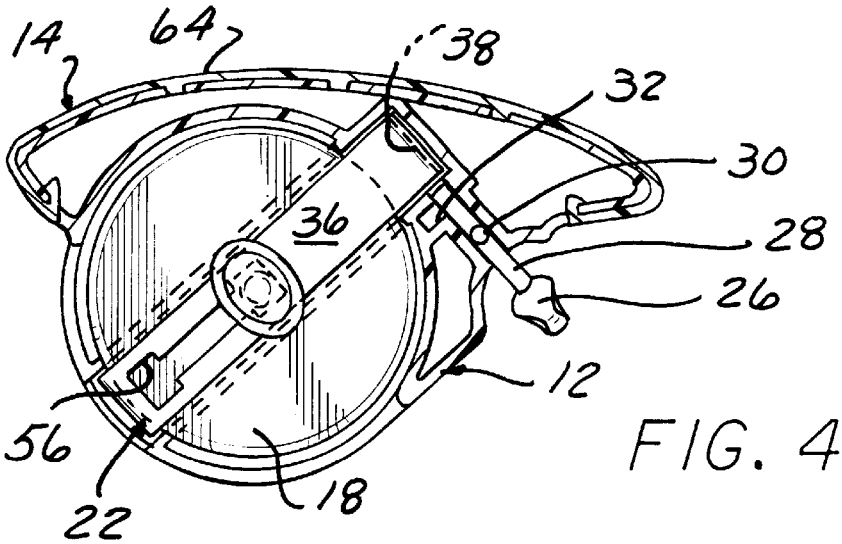
FIG. 4 is a partially sectional view of the roller cutter shown in FIGS. 1–3 with the cutter wheel holder slide bar released and able to be removed.
Figure 5:
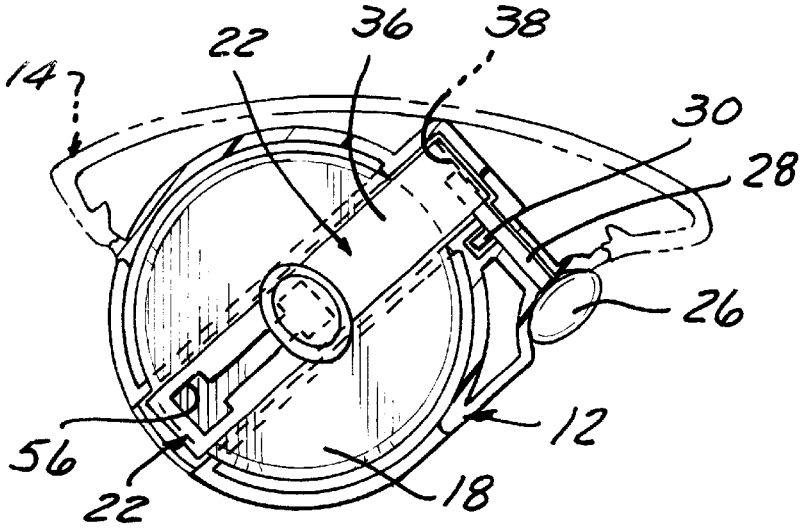
FIG. 5 is a partially sectional view of the roller cutter shown in FIGS. 1–4 with the holder slide locked in position in the housing.

FIG. 4 shows that the grip 14 molded from a hard plastic with the housing 12, is covered with a layer of a soft elastomeric material 64 such as SANTOPRENE™ for an improved more comfortable grip. The grip 14 extends linearly along the top of the partially circular housing 12.

Figure 6:
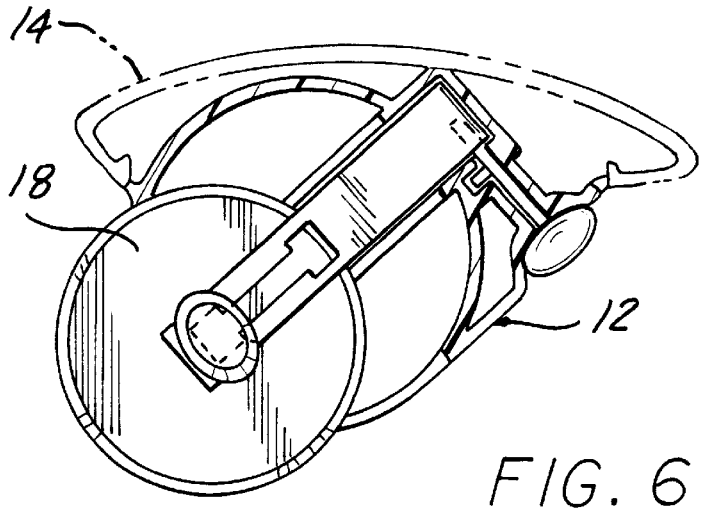
FIG. 6 is a reduced size partially sectional view of the roller cutter shown in FIGS. 1–5 with the cutter wheel in its extended cutting position.

FIG. 6 shows that the cutting wheel 18 is positioned substantially directly below the grip 14, so that it is easy to exert substantial downward pressure while executing a rapid side to side stroking when grasping the grip 14.

This improves the versatility of the roller cutter 10 shown, as it may be conveniently useable in mincing nuts, herbs and the like with a rapid back and forth stroke. This is more cumbersome with a conventional pizza cutter.

Furthermore, the elevated position of the grip 14 over the cutting wheel 18 minimizes the chances of the fingers or hand contacting the food being cut.

The downward and forward inclination of the slot 24 and slide bar 22 positions the cutter wheel 18 forward and below the housing 12 for better visibility of the cutting edge when executing this cutting action but allowing a downward pressure to be easily exerted.

What is claimed is:

1. A roller cutter comprising:

a housing;

a hand grip on the top of said housing;

a cutter wheel rotatably mounted in said housing, said cutter wheel being movable between a retracted position enclosed within said housing and an extended cutting position at least partially protruding from the bottom of said housing;

a split in said housing in which said cutter wheel is recessed and from which said cutter wheel is extended;

an axle pin rotationally holding said cutter wheel; and a slide bar received in a slot in said housing, said slide bar having a lengthwise slot through which said axle pin extends, said lengthwise slot accommodating movement of said cutter wheel between said retracted and extended cutting positions.

2. The roller cutter according to claim 1 further including a pair of latching stops releasably latching said cutter wheel in either of said positions.

3. The roller cutter according to claim 1 wherein an enlarged cut out is at either end of said lengthwise slot, said axle pin has a release push button attached at one end thereof, said push button having a smaller portion and a larger portion projecting towards said pin, said smaller portion slidable in said lengthwise slot, said larger portion able to be received in said cut outs but not slidable in said lengthwise slot, said axle pin and said release push button axially movable and spring urged to tend to position said larger portion in said cut outs, whereby latching said cutter wheel in either cut out corresponding to said retracted and extended positions.

4. The roller cutter according to claim 1 wherein said housing slot is a downwardly and forwardly extending slot along which said cutter wheel shifts in moving between said retracted and extended positions.

5. The roller cutter according to claim 1 wherein said housing is partially circular and said grip extends generally tangentially along the top thereof.

6. The roller cutter according to claim 5 wherein said grip is covered with a soft elastomeric layer.

7. The roller cutter according to claim 1 further including a releasable lock normally holding said slide bar in said housing slot but releasable to allow said slide bar and said cutter wheel to be removed from said housing slot.

8. The roller cutter according to claim 7 wherein said releasable lock includes a locking pin capturing said slide bar when fully seated in said housing, but which can be withdrawn to release said slide bar.

9. The roller cutter according to claim 8 wherein said releasable lock includes a turnable knob affixed to said locking pin which allows withdrawal of said pin in one turned position.

* * * * *